US009909267B1

(12) United States Patent
Ligman

(10) Patent No.: US 9,909,267 B1
(45) Date of Patent: Mar. 6, 2018

(54) PAVER HEAD ASSEMBLY

(71) Applicant: LIGCHINE INTERNATIONAL CORPORATION, Floyds Knobs, IN (US)

(72) Inventor: Peter A. Ligman, Clinton, WI (US)

(73) Assignee: Ligchine International Corporation, Floyds Knobs, IN (US)

( * ) Notice: Subject to any disclaimer, the term of this patent is extended or adjusted under 35 U.S.C. 154(b) by 0 days.

(21) Appl. No.: 14/639,753

(22) Filed: Mar. 5, 2015

Related U.S. Application Data

(60) Provisional application No. 61/948,355, filed on Mar. 5, 2014.

(51) Int. Cl.

| | |
|---|---|
| ***E01C 19/40*** | (2006.01) |
| ***E01C 19/22*** | (2006.01) |
| ***E01C 7/00*** | (2006.01) |
| ***E01C 19/41*** | (2006.01) |
| ***E01C 19/38*** | (2006.01) |

(52) U.S. Cl.
CPC ..... *E01C 19/40* (2013.01); *E01C 7/00* (2013.01); *E01C 19/22* (2013.01); *E01C 19/38* (2013.01); *E01C 19/41* (2013.01)

(58) Field of Classification Search
CPC . E01C 7/00; E01C 19/40; E01C 19/22; E01C 19/38; E01C 19/41; E01C 19/00; E01C 19/405; E01C 19/238
See application file for complete search history.

(56) References Cited

U.S. PATENT DOCUMENTS

| | | | | |
|---|---|---|---|---|
| 1,731,231 | A * | 10/1929 | Chenoweth | E01C 19/4826 404/103 |
| 3,341,029 | A | 10/1965 | Barkley et al. | |
| 3,377,933 | A * | 4/1968 | Dale | E01C 19/405 404/106 |
| 3,675,721 | A | 7/1972 | Davidson et al. | |
| 3,721,054 | A | 3/1973 | Hornagold | |
| 3,870,427 | A * | 3/1975 | Allen | E01C 19/29 404/103 |
| 4,036,372 | A | 7/1977 | Rao et al. | |
| 4,406,375 | A | 9/1983 | Hockensmith | |
| 4,700,786 | A | 10/1987 | Berry | |
| 4,770,304 | A | 9/1988 | Woods | |
| 4,896,995 | A | 1/1990 | Simmons | |
| 5,009,546 | A | 4/1991 | Domenighetti et al. | |
| 5,039,249 | A | 8/1991 | Hansen et al. | |
| 5,129,803 | A * | 7/1992 | Nomura | E01C 19/00 404/102 |
| 5,217,320 | A | 6/1993 | Cioffi | |
| 5,234,281 | A | 10/1993 | Somero et al. | |
| 5,515,654 | A | 5/1996 | Anderson | |
| 6,129,481 | A * | 10/2000 | Tapio | E04G 21/10 404/102 |
| 6,227,761 | B1 * | 5/2001 | Kieranen | E01C 19/40 404/118 |

(Continued)

*Primary Examiner* — Abigail A Risic
(74) *Attorney, Agent, or Firm* — Middleton Reutlinger; Alexander P. Brackett

(57) ABSTRACT

This application is for an improved paver head for smoothing and finishing poured concrete surfaces. It includes a strike-off plow for initial leveling of concrete, an auger for mixing and smoothing surface imperfections, a roller for smoothing and leveling, and a finish blade for final surface finishing of a poured concrete surface.

14 Claims, 7 Drawing Sheets

(56) References Cited

U.S. PATENT DOCUMENTS

| | | | | |
|---|---|---|---|---|
| 6,328,115 | B1 | 12/2001 | Carter, Jr. | |
| 6,447,204 | B1 * | 9/2002 | McDonald | E01C 19/405 404/118 |
| 6,481,924 | B1 | 11/2002 | Smolders et al. | |
| 6,530,721 | B2 | 3/2003 | Yost | |
| 6,695,532 | B2 | 2/2004 | Somero et al. | |
| 6,729,796 | B1 | 5/2004 | Green | |
| 6,857,816 | B2 | 2/2005 | Saito et al. | |
| 6,860,676 | B2 | 3/2005 | Pont Feixes | |
| 7,044,681 | B2 | 5/2006 | Quenzie et al. | |
| 7,121,762 | B2 | 10/2006 | Quenzie et al. | |
| 7,144,191 | B2 | 12/2006 | Kieranen et al. | |
| 7,175,363 | B2 | 2/2007 | Quenzie et al. | |
| 7,195,423 | B2 | 3/2007 | Halonen et al. | |
| 7,232,277 | B2 | 6/2007 | Corbitt | |
| 7,320,558 | B2 | 1/2008 | Quenzie et al. | |
| 7,396,186 | B2 | 7/2008 | Quenzie et al. | |
| 7,407,339 | B2 | 8/2008 | Halonen et al. | |
| 7,497,140 | B2 | 3/2009 | Blackwelder et al. | |
| 7,685,929 | B2 | 3/2010 | Mainville | |
| 8,591,142 | B2 | 11/2013 | Mittleman | |
| 2003/0161684 | A1 * | 8/2003 | Quenzi | E01C 19/006 404/75 |
| 2004/0076472 | A1 * | 4/2004 | Holmes | E01C 19/42 404/118 |
| 2005/0141963 | A1 * | 6/2005 | Holmes | E01C 19/42 404/118 |
| 2006/0120801 | A1 * | 6/2006 | Johnson | E01C 19/006 404/118 |
| 2007/0116520 | A1 | 5/2007 | Quenzie et al. | |
| 2014/0363232 | A1 * | 12/2014 | Pietila | E01C 19/405 404/118 |

* cited by examiner 10
100
102
104
28
26
110
32
24
30
22
20
40
130
140
4

PAVER HEAD ASSEMBLY

CROSS-REFERENCE TO RELATED APPLICATIONS

The present application claims the benefit of and priority to U.S. Provisional Patent Application Ser. No. 61/948,355 filed Mar. 5, 2014 and entitled "Paver Head Assembly".

BACKGROUND OF THE INVENTION

Field of the Invention

The present invention relates generally to a system and apparatus for troweling or screeding concrete and more specifically to an improved paver head for finishing a concrete surface using a portable concrete screeding machine. The improved paver head provides a series of surface finishing components arranged to provide a consistent and even finished concrete surface as it is moved or passed across an unfinished surface.

Description of the Related Art

In the construction industry when liquid concrete is poured to produce a finished level surface it must be carefully leveled and smoothed, or screeded, so that when the concrete sets it produces an even, level surface. Since this level surface is almost always a foundation for additional construction, machine base applications, or for vertical storage such as warehousing space, it is highly desirable to produce a surface that is consistently level over its entire area. In large poured areas it is unwieldy and labor intensive to manually level and smooth a poured surface as well as extremely difficult to maintain a consistent finished grade.

In order to aid in the screeding of large surface area concrete pours, a variety of screeding or troweling machines have been accepted into use in the art. These machines typically include a screed or paver head comprising a flat troweling surface for contacting the poured concrete mounted on a boom that is mechanically extended and retracted across the concrete surface to produce a smooth finish thereon. Many of these prior art devices include various mechanisms that contact the concrete such that the finished surface is relatively flat once it is screeded.

Some prior art paver heads include components such as a plow for making initial contact on a screeding pass, an auger for contacting the concrete to produce a homogeneous surface, or a finish blade for smoothing the concrete. Often the finish blade is provided with a source of vibratory motion, to further work air bubbles and imperfections out of the concrete surface as the finish blade is pulled across it.

However, recent advances in concrete technology have seen the widespread use of "pervious" concrete, or concrete that has intentional air pockets therein to facilitate drainage through the concrete surface while maintaining structural integrity. Prior art screed heads tend to ruin the porosity of pervious concrete because typical vibrating finish blades seal the pores on the top surface of the concrete.

Additionally, the concrete mix used for parking lots and roads tends to be denser or "stickier" than that used in, for example, a building floor. As a result, it is more difficult to smooth with conventional paver heads. While some large scale road pavers are capable of handling such concrete pours, more portable screeding machines are not.

Accordingly, there is a need in the art for a system and method screeding and troweling concrete using a boom-type or other portable screeder that provides a paver head capable of handling concrete conventionally used in road and parking lot construction.

Other features, objects and advantages of the present invention will become apparent from the detailed description of the drawing Figures taken in conjunction with the appended drawing Figures.

BRIEF DESCRIPTION OF THE DRAWING FIGURES

DETAILED DESCRIPTION OF THE PREFERRED EMBODIMENT(S)

Figures 1, 2:
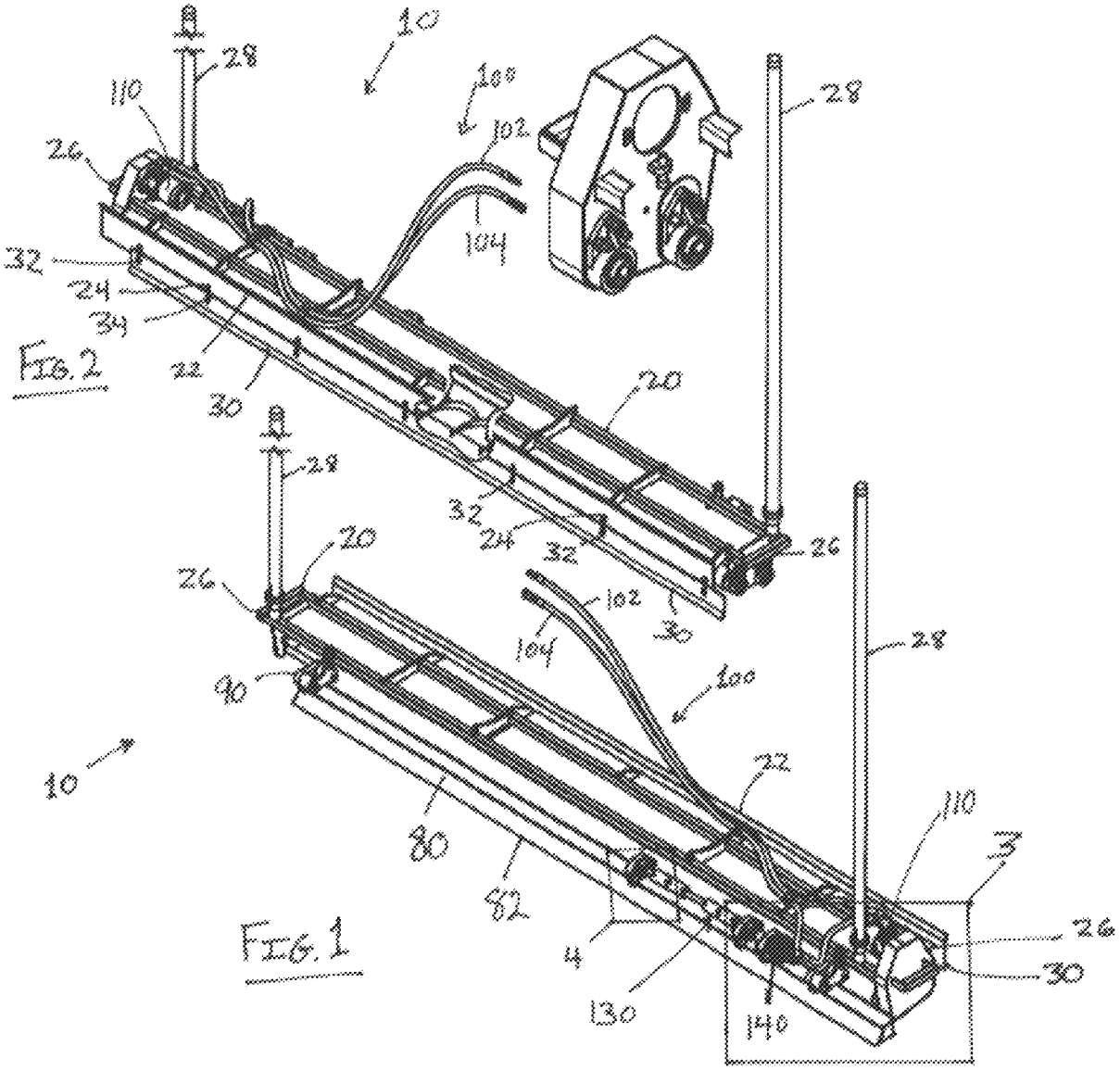
FIG. 1 is a perspective view of a paver head in accordance with one embodiment of the present invention.
FIG. 2 is a perspective view of a paver head in accordance with one embodiment of the present invention.
Figures 3, 4:
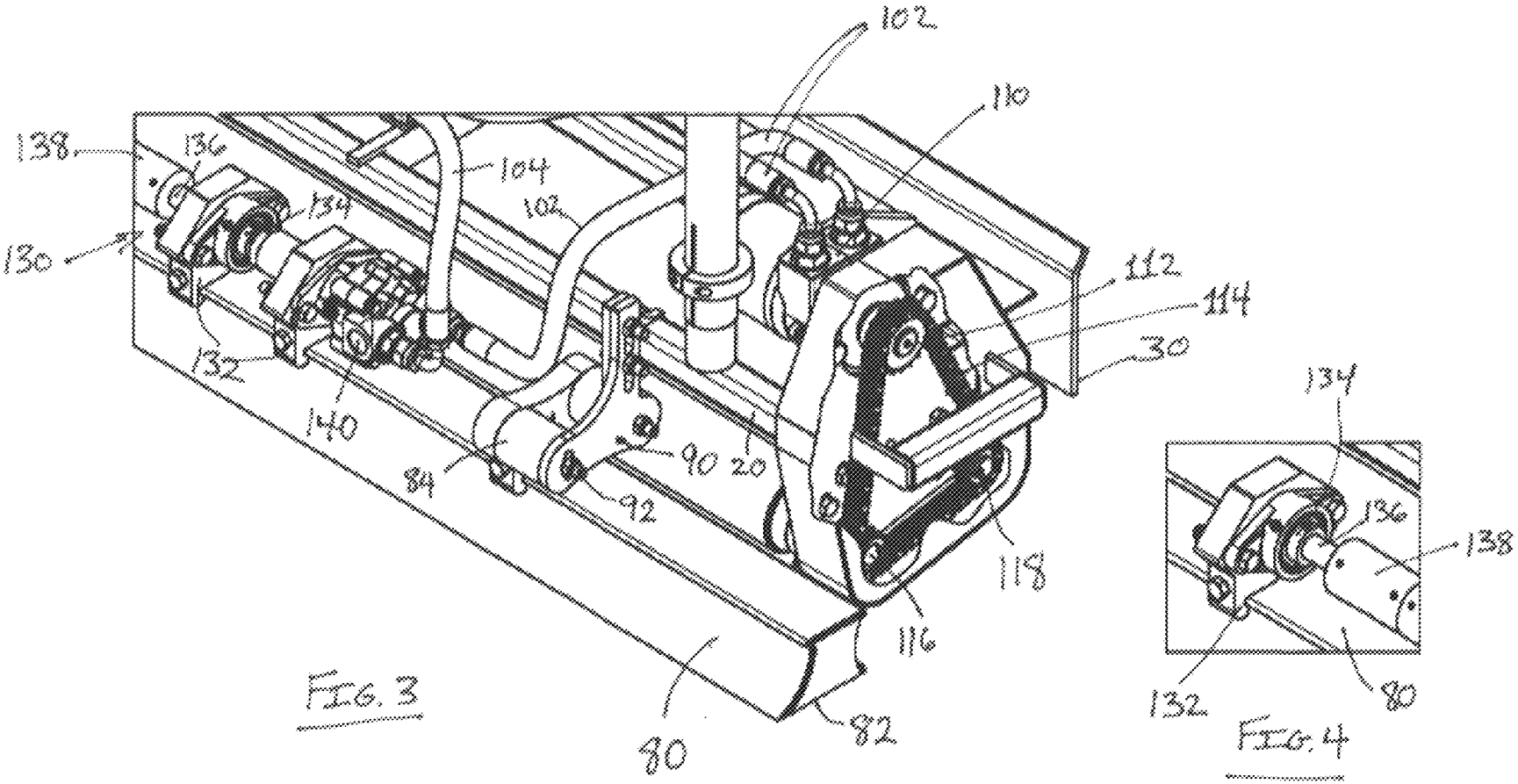
FIG. 3 is a detail view of detail area 3 of the paver head of FIG. 1 in accordance with one embodiment of the present invention.
FIG. 4 is a detail view of detail area 4 of the paver head of FIG. 1 in accordance with one embodiment of the present invention.
Figure 5:
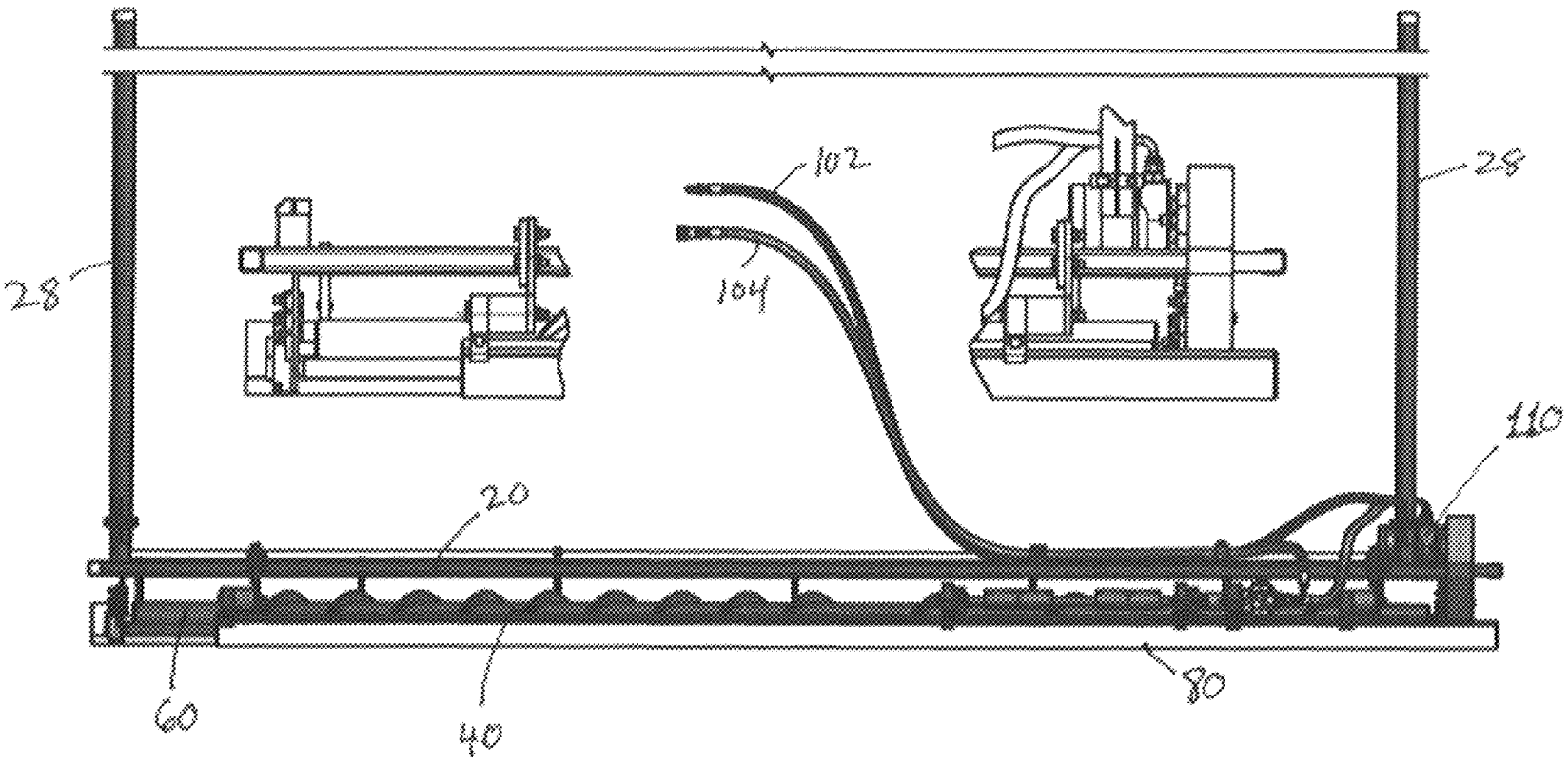
FIG. 5 is a side view of a paver head in accordance with one embodiment of the present invention.
Figure 7:
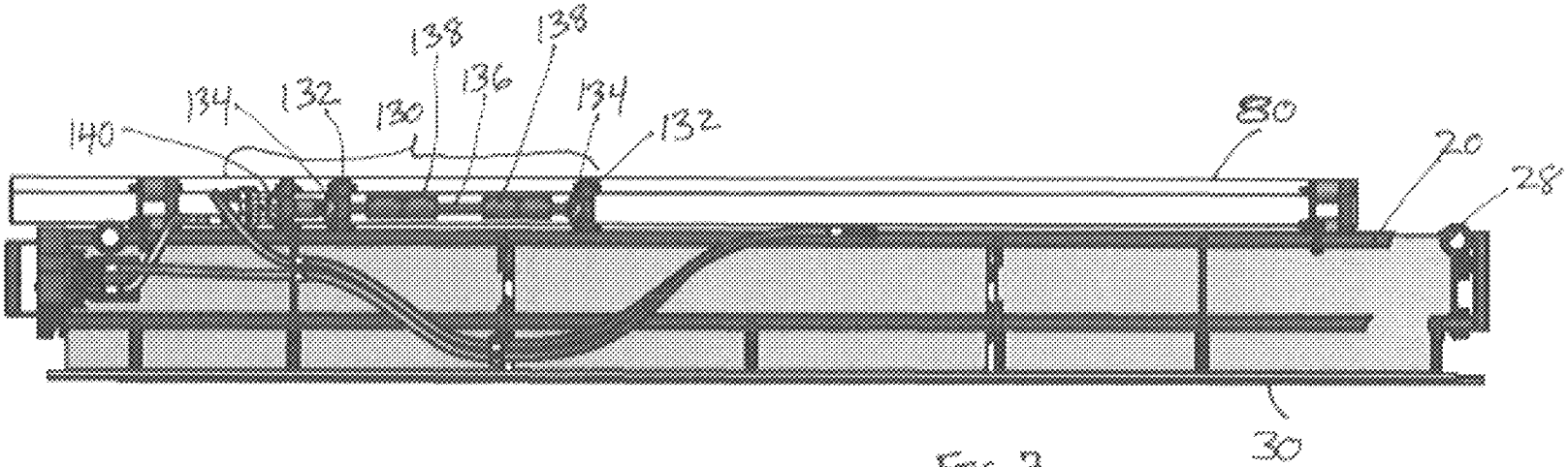
FIG. 7 is a top view of a paver head in accordance with one embodiment of the present invention.

Referring now to FIGS. 1 and 2 and in accordance with one embodiment of the present invention a paver head 10 for a boom-type concrete screeder (not shown) comprises a frame 20 for partially enclosing and protecting various components of paver head 10 as well as mounting paver head 10 to a screed boom or similar assembly. Frame 20 may also include a pair of vertically oriented leveling eye mounting poles 28 at opposed ends 26 thereof for securing leveling eyes thereto, as is known in the art. It should be noted that reference to boom-type portable concrete screeders throughout this specification should not be taken as limiting of the scope of paver head 10. Boom-type screeders are known in the art and are one of many screeder types onto which paver head 10 may be secured to finish a poured concrete surface.

Figure 6:
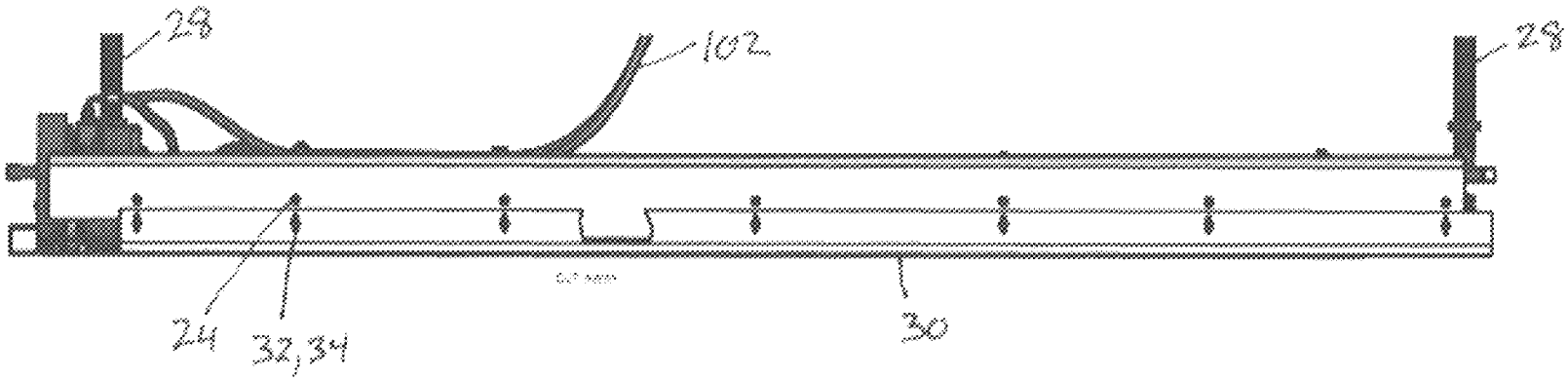
FIG. 6 is a side view of a paver head in accordance with one embodiment of the present invention.

Referring also to FIG. 6, a plow 30 is secured to frame 20 on a rear side 22 thereof at a plurality of locations via fasteners 32, for example bolts and concomitant nuts. Plow 30 is secured to frame 20 to provide initial grading or leveling of a poured concrete surface as paver head 10 is retracted across the poured concrete surface. Plow 30 may be secured to frame 20 by inserting fasteners 32 through plurality of slots or apertures 34 in plow 30 and corresponding slots or apertures 24 in frame 20, thereby permitting vertical adjustment of plow 30 with respect to the poured concrete surface prior to setting a grade level for paver head 10, as will be discussed further herein below. Plow 30 is positioned on rear side 22 of frame 20 to provide an initial leveling pass across the concrete being screeded prior to the remainder of paver head 10 reaching the concrete.

Figure 8:
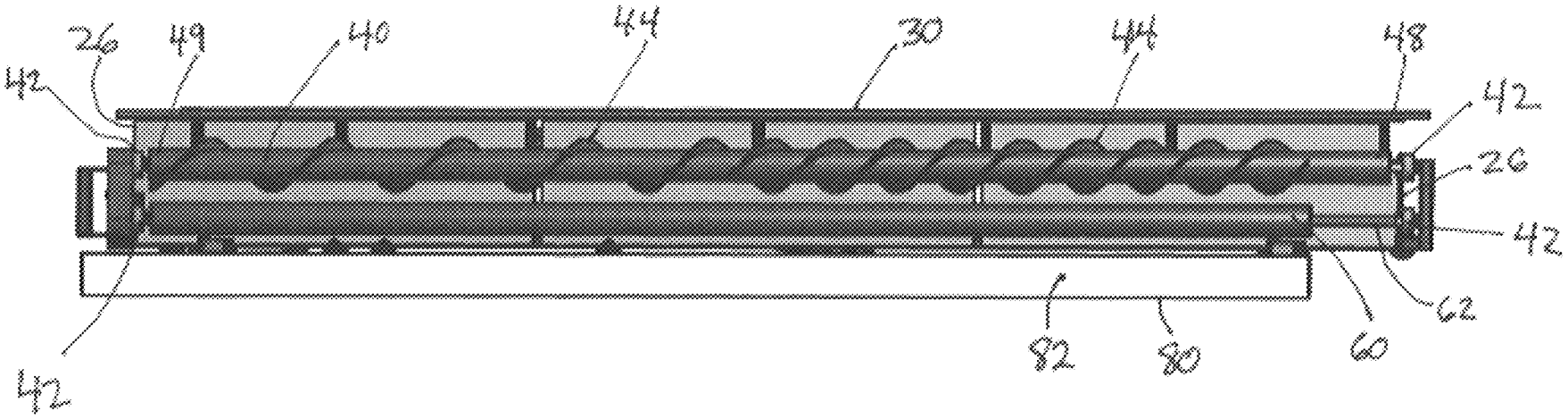
FIG. 8 is a bottom view of a paver head in accordance with one embodiment of the present invention.
Figure 10:
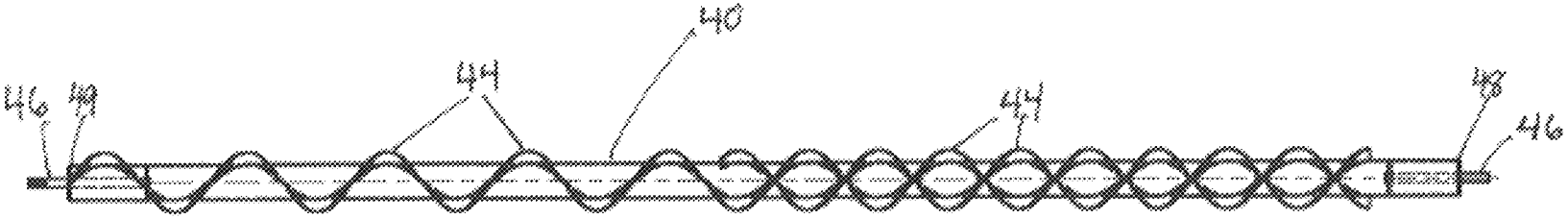
FIG. 10 is a side view of an auger in accordance with one embodiment of the present invention.
Figure 9:
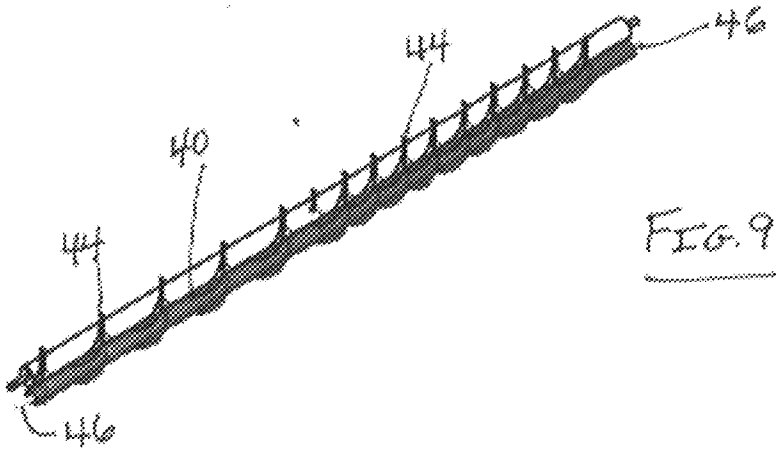
FIG. 9 is a perspective view of an auger in accordance with one embodiment of the present invention.

As shown in FIGS. 8-10 a generally cylindrical auger 40 is journaled for rotation between a pair of bearings 42 secured to opposed sides 26 of frame 20. Auger 40 may be constructed of hardened steel and is generally cylindrical in shape and includes a helical blade 44, or a plurality thereof, extending outwardly from and around the circumference of auger 40 along substantially its entire length. Auger 40 may also include a central longitudinal shaft 46 extending from the ends 48, 49 of auger 40 around which auger 40 rotates.

In one embodiment of the invention, helical blade 44 varies in its frequency of rotation around auger 40 along its length, so that blade 44 circumscribes auger 40 more frequently along a portion thereof. In a further embodiment of the present invention, auger 40 blade 44 is double-flighted along a portion of auger 40 so that two blades 40 are helically arranged around auger 40 on a portion thereof. This feature of the invention provides paver head 10 with the ability to rapidly move concrete displaced by blades 44 from one end 49 of auger 40 to another end 48 as auger rotates and paver head 10 is advanced in a screeding pass. In a yet further embodiment of the invention auger 40 is secured in frame 20 adjacent plow 30.

Figure 11:
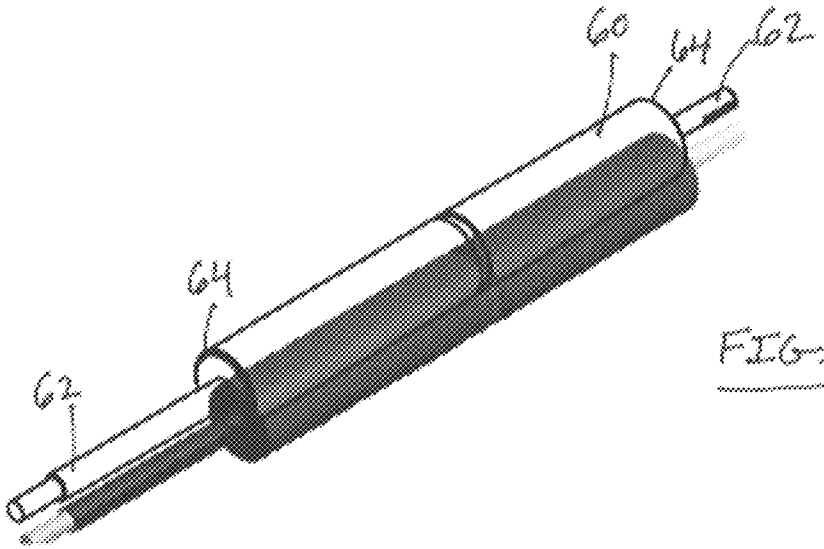
FIG. 11 is a perspective view of a roller in accordance with one embodiment of the invention.
Figure 12:
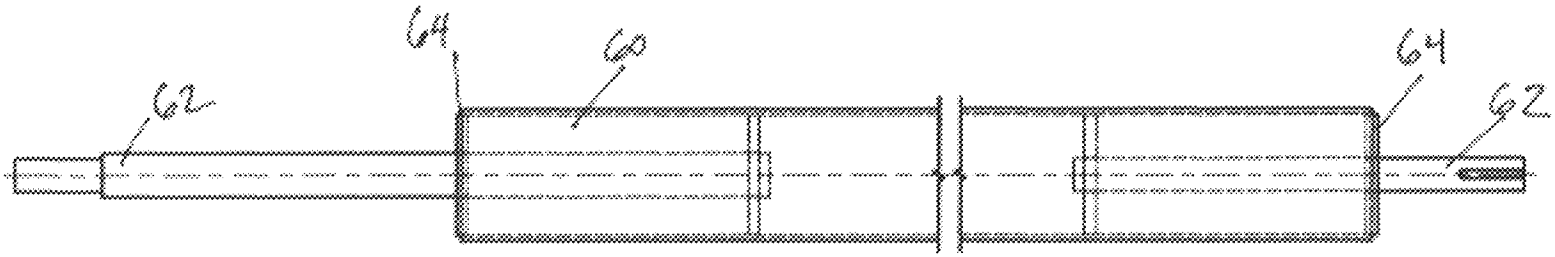
FIG. 12 is a side view of a roller in accordance with one embodiment of the invention

As best seen in FIGS. 8, 11 and 12 paver head 10 further comprises a generally cylindrical roller 60 having a pair of longitudinal shafts 62 extending from opposed ends 64 thereof. Roller 60 has a smooth cylindrical surface for contacting and smoothing concrete on a screeding pass. Shafts 62 are journaled for rotation in a pair of bearings 42 secured to opposed sides 26 of frame 20. In one embodiment of the invention 10 roller 60 is constructed of hardened steel and is positioned in frame 20 adjacent auger 40, such that auger 40 is positioned between plow 30 and roller 60. Rotating roller 60 acts to smooth the poured concrete surface that has just been agitated by auger 40 as paver head 10 is moved across it in a screeding pass.

Referring again to FIGS. 1-3 and 8 paver head 10 may further comprise a finish blade 80 having a concrete finishing surface 82 that is designed to smooth and level the poured concrete as it is being screeded. Finish blade 80 is secured to frame 20 by a plurality of mounting brackets 90 that permit both the height of blade 80 and the angle of finish surface 82 to be adjusted relative to the concrete surface. Brackets 90 permit finish blade 80 to pivot around annular mount 84 that is secured to bracket 90 by a fastener 92, thereby permitting adjustment of finish blade 80 finish surface 82 relative to the concrete being screeded. This feature of the present invention 10 facilitates screeding of concrete having widely varying consistency. In one embodiment of the invention finish blade 80 extends substantially along the length of frame 20.

Referring again to FIGS. 1-5 paver head 10 may include an hydraulic system 100 that includes an hydraulic supply 102 and return 104 line for supplying various components of the invention 10 with pressurized hydraulic fluid through operation of a conventional hydraulic pump (not shown). An hydraulic drive motor 110 is secured to frame 20 proximate one side 26 thereof, and is driven by pressurized hydraulic fluid supplied via supply line 102. Motor 110 drives a central shaft and concomitant sprocket 112 that is in turn linked through a drive chain 114 or belt to a roller sprocket 116 and an auger sprocket 118. Roller sprocket 116 is secured to roller shaft 62 while auger sprocket 118 is secured to auger shaft 46.

Thus drive motor 110, when supplied with pressurized hydraulic fluid, provides rotation to both auger 40 and roller 60. In one embodiment of the invention 10 sprockets 116 and 118 may be independently sized with appropriate circumferences to provide a desired amount of roller 60 or auger 40 rotation for a given drive motor 100 rotational speed, thus providing the ability to customize paver head 10 to finish a wide variety of concrete surfaces. One of ordinary skill in the art will recognize that although the instant specification discusses driving auger 40 and roller 60 with an hydraulic motor, a wide variety of motors, such as electric and internal combustion, may be used in conjunction with paver head 10 without departing from the scope of the instant invention.

Paver head 10 may further comprise a vibration system 130, best seen in FIGS. 1, 3, 4 and 7. Vibration system 130 is secured to finish blade 80 at a plurality of locations via brackets 132. Each bracket 132 includes a bearing 134. A vibrator rod 136 is journaled for rotation in bearings 134 and is secured at one end to an hydraulic vibrator motor 140 that rotates rod 136 when supplied with pressurized hydraulic fluid via supply line 102.

A plurality of eccentric weights 138 are secured to, or around vibrator rod 136, thereby rotating with rod 136. Accordingly, when motor 140 rotates rod 136, eccentric weights 138 also rotate thereby imparting vibratory force to finish blade 80 through brackets 132. This feature of the present invention 10 provides a smooth and consistent finished concrete surface as paver head 10 and thus finish blade 80 finishing surface 92 are drawn across the poured concrete in a screeding pass.

In one embodiment of the present invention the components of paver head 10 are arranged, from front to back, on frame 20 in the order: finish blade 80, roller 60, auger 40, and finally plow 30. This feature of the present invention depicted in FIG. 8, for example, provides a paver head 10 having superior screeding performance over a wide array of concrete consistencies.

In a yet further embodiment of the invention roller 60 and auger 40 may be reversed in their order, such that roller 60 contacts the concrete that has been initially smoothed and leveled by plow 30 prior to auger 40. This feature of the invention may prove advantageous for concrete pours that are very uneven or "lumpy".

While the present invention has been shown and described herein in what are considered to be the preferred embodiments thereof, illustrating the results and advantages over the prior art obtained through the present invention, the invention is not limited to those specific embodiments. Thus, the forms of the invention shown and described herein are to be taken as illustrative only and other embodiments may be selected without departing from the scope of the present invention, as set forth in the claims appended hereto.

I claim:

1. A paver head for use with a concrete screeder for screeding poured concrete to produce a level finished surface comprising:

a mounting assembly having a frame for securing said paver head to said concrete screeder;

a plow secured to said frame at a rear portion thereof for initial grading of said concrete;

an auger secured to said frame forward of and adjacent to said plow, said auger journaled for rotation around a central longitudinal axis;

a roller secured to said frame forward of and adjacent to said auger and journaled for rotation around a central longitudinal axis to smooth said concrete; and a finish blade secured to said frame forward of and adjacent to said roller, said finish blade having a finish surface for contacting and smoothing said concrete.

2. A paver head as claimed in claim 1 wherein said finish blade comprises:

a vibration system secured to said finish blade for smoothing said concrete.

3. A paver head as claimed in claim 1 wherein said roller is secured to said frame adjacent to said plow and said auger is secured to said frame between said roller and said finish blade.

4. A paver head as claimed in claim 1 wherein said finish blade is secured to said frame by a plurality of brackets that permit adjustment of the height and angle of said finish blade surface relative to said concrete.

5. A paver head as claimed in claim 1 wherein said auger comprises:

a cylinder having a helical blade secured to and extending therefrom.

6. A paver head as claimed in claim 1 wherein said auger comprises:

a cylinder having a first helical blade secured to and extending therefrom along substantially the length of said cylinder; and a second helical blade secured to and extending from said cylinder along a portion thereof.

7. A paver head as claimed in claim 1 comprising:

a drive motor secured to said frame at an end thereof, said drive motor rotating a shaft secured to a sprocket;

a sprocket secured to each of said auger and said roller; and a chain connecting said drive motor sprocket to said auger and roller sprockets, thereby providing rotation to said roller and auger.

8. A paver head as claimed in claim 2 comprising:

a vibration rod secured to said finish blade and journaled for rotation;

at least one eccentric weight secured to said vibration rod; and a vibrator motor having a shaft secured to said vibration rod for rotating said rod and thereby providing vibratory force to said finish blade.

9. A paver head as claimed in claim 7 wherein said drive motor is an hydraulic motor.

10. A paver head as claimed in claim 8 wherein said vibrator motor is an hydraulic motor.

11. A paver head for use with a concrete screeder for screeding poured concrete to produce a level finished surface comprising:

a frame for securing said paver head to said concrete screeder;

a plow vertically adjustably secured to said frame at a rear portion thereof for initial grading of said concrete;

an auger having an helical blade extending therefrom, said auger rotatably secured to said frame forward of and adjacent to said plow;

a cylindrical roller rotatably secured to said frame forward of and adjacent to said auger to smooth said concrete; and a finish blade adjustably secured to said frame forward of and adjacent to said roller, said finish blade having a finish surface for contacting and smoothing said concrete.

12. The paver head of claim 11 wherein said auger and said roller are comprised of hardened steel.

13. The paver head of claim 11 further comprising:

a vibration system secured to said paver head for imparting vibratory force to said finish blade.

14. A paver head for use with a concrete screeder for screeding poured concrete to produce a level finished surface comprising:

a frame for securing said paver head to said concrete screeder;

a plow adjustably secured to said frame at a rear portion thereof for initial grading of said concrete;

an auger having an helical blade extending therefrom, said auger rotatably secured to said frame forward of and adjacent to said plow;

a cylindrical roller rotatably secured to said frame forward of and adjacent to said auger to smooth said concrete;

a drive motor having a rotating shaft and concomitant sprocket, said sprocket connected to said rotatable auger and roller to provide rotation thereto; and a finish blade adjustably secured to said frame forward of and adjacent to said roller, said finish blade having a finish surface for contacting and smoothing said concrete.

* * * * *